US006068259A

United States Patent [19]

Dolin

[11] Patent Number: 6,068,259

[45] Date of Patent: May 30, 2000

[54] HOCKEY BOARD GAME

[76] Inventor: Ty Douglas Dolin, 4283 6th St., Ecorse, Mich. 48229

[21] Appl. No.: 09/167,943

[22] Filed: Oct. 7, 1998

[51] Int. Cl.[7] ..... A63F 3/00

[52] U.S. Cl. ..... 273/244; 273/259; 273/277

[58] Field of Search ..... 273/FOR 236, 273/242, 243, FOR 244, FOR 259, FOR 277, FOR 287, FOR 288, 108.5, 108.1, 248, 249

[56] References Cited

U.S. PATENT DOCUMENTS

| | | | |
|---|---|---|---|
| D. 150,249 | 7/1948 | Parrilla . | |
| 1,147,218 | 7/1915 | Dawson . | |
| 2,052,797 | 9/1936 | Read . | |
| 2,549,708 | 4/1951 | Post . | |
| 3,455,556 | 7/1969 | Mossman | 273/134 |
| 3,656,757 | 4/1972 | Carroll . | |
| 3,858,885 | 1/1975 | Adcock . | |
| 3,895,798 | 7/1975 | Collins | 273/85 R |
| 3,907,295 | 9/1975 | Eissler | 273/85 R |
| 4,010,957 | 3/1977 | Tricoli | 273/134 AD |
| 4,468,028 | 8/1984 | Mustin | 273/85 R |
| 4,907,809 | 3/1990 | Nakayama . | |
| 4,955,616 | 9/1990 | Ingalls . | |
| 5,108,110 | 4/1992 | Nerbas | 273/244 |
| 5,288,075 | 2/1994 | Kelley . | |
| 5,876,211 | 3/1999 | Schmoyer . | |

*Primary Examiner*—Jeanette Chapman
*Assistant Examiner*—V K Mendiratta
*Attorney, Agent, or Firm*—Henderson & Sturm LLP

[57] ABSTRACT

A hockey board game including a game board in the general shape of a hockey rink with two tracks, each track running around the circumference and each track ending with a track to one of the two scoring nets. The game also includes a number of playing cards, game pucks, and game cards used in the play of the game.

1 Claim, 1 Drawing Sheet

HOCKEY BOARD GAME

BACKGROUND OF THE INVENTION

1. Field of the Invention

The present invention relates to the field of board games, and more particularly to a hockey board game.

2. Description of Related Art

As can be seen by reference to the following U.S. Pat. Nos. 3,455,556; 3,895,798; 3,907,295; 4,010,957; 4,468,028; and 5,108,110, the prior art is replete with myriad and diverse board games.

While all of the aforementioned prior art constructions are more than adequate for the basic purpose and function for which they have been specifically designed, they are uniformly deficient with respect to their failure to provide a simple, efficient, and practical realistic hockey board game.

As a consequence of the foregoing situation, there has existed a longstanding need for a new and improved hockey board game, and the provision of such a construction is a stated objective of the present invention.

BRIEF SUMMARY OF THE INVENTION

Briefly stated, the present invention provides a hockey board game including a game board in the general shape of a hockey rink with two tracks, each track running around the circumference and each track ending with a track to one of the two scoring nets. The game also includes a number of playing cards, game pucks, and game cards used in the play of the game.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
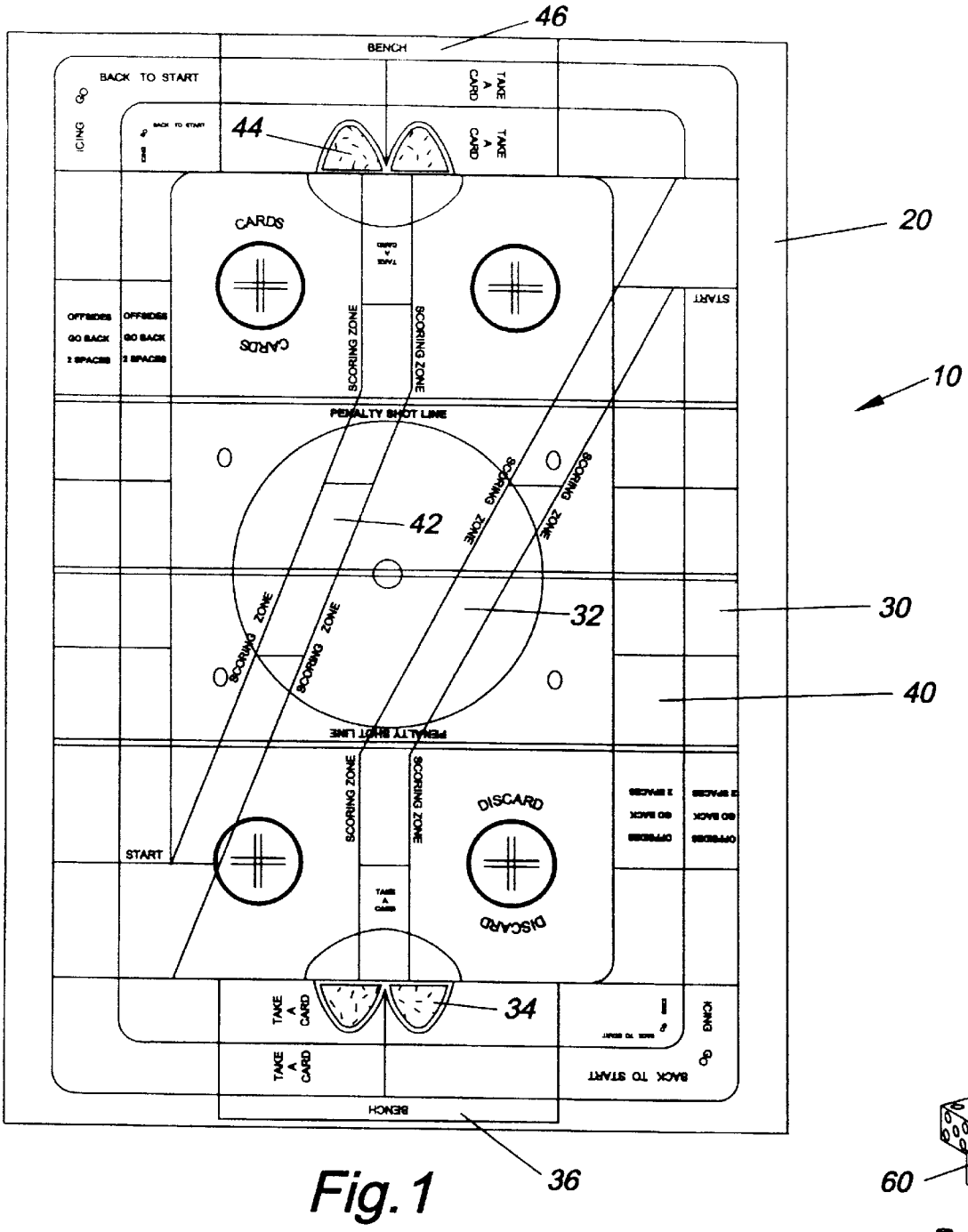
FIG. 1 is a top plan view of the game board of the present invention.
Figure 2:
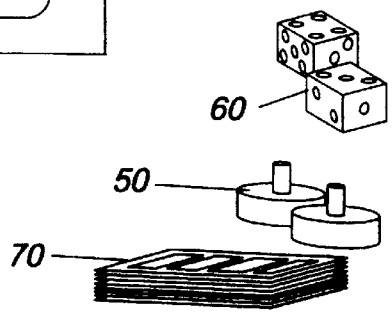
FIG. 2 is a perspective view of the game dice, game pucks, and game cards.

As can be seen by reference to the drawings, and in particularly to FIG. 1, the hockey board game that forms the basis of the present invention is designated generally by the reference number 10. The game board 20 is fabricated out of plastic or cardboard and is in the shape of a hockey rink with two tracks 30 and 40, each track running around the circumference and each track ending with a track 32, 42 to one of the two scoring nets 34, 44. Miniature hockey pucks 50 with different colors for each team are used as game pieces. The tracks are sectioned off in squares to allow movement of the pieces when the dice 60 are thrown. The game board incorporates a bench area 36, 46 at each end and an area to place the playing cards 70. The game contents include ten pucks 50, five for each team of which four are used in play, with the other being a spare in the event of loss, two dice 60, game cards 70, and the hockey board 20. Game cards 70 include: (1) five penalty shot cards (can be used anytime); (2) backhand shot—save; (3) backhand shot—scores; (4) glove save; (5) hit the crossbar; (6) hit the goal post; (7) kick save off the pads; (8) off the mask; (9) stick save; (10) slap shot—what a save; (11) slap shot—scores; (12) wrist shot—what a save; (13) wrist shot—scores; (14) score under the arm; (15) score between the legs; (16) score over the shoulder; (17) score through the glove; (18) goal under review—goal; (19) goal under review—no goal; (20) no goal—whistle blew; (21) tip in—he scores; (22) tip in—what a save; (23) cross checking—go back 3 spaces; (24) check from behind—go back 3 spaces; (25) diving penalty—go back 1 space; (26) delay of game—go back 1 space; (27) elbowing—go back 2 spaces; (28) fighting—go back 2 spaces; (29) high sticking—go back 2 spaces; (30) hooking—go back 2 spaces; (31) holding—go back 1 space; (32) hand pass—go back 1 space; (33) tripping—go back 1 space; (34) interference—go back 2 spaces; (35) unsportsman like conduct—go back 3 spaces; (36) spearing—go back 3 spaces; (37) slashing—go back 3 spaces; (38) too many men on the ice—take 1 man off; (39) butt ending—go back 3 spaces; and (40) boarding—go back 2 spaces.

The games rules are as follows: The object of the game is to follow your shaded area, as each player takes their turn rolling the dice. While following your path, you would observe all rules on the board, and on any drawn cards. Once you have made it all the way around the board to the area just below the start block, you would continue on your way up to the scoring zone, advancing to the net and trying to score. If you accidentally pass up the scoring zone, you must go all the way back around the board to get the chance to score again. Remember to follow all rules on the board and on the cards.

To set up the game, put the pucks on the spot marked bench. Each team gets five pucks with one team being white, and one team being black. Players decide which they will use.

Shuffle cards and place them face down on the face off sport marked "cards". After each card is used, place it on the face off sport marked "discard". When all cards have been drawn, reshuffle the discards and return them to the original spot.

To start the game, each player rolls one die to see who goes first. The highest roll wins, and that players gets to choose between the light blue path or the white path on the playing board. To move around the board, both dice are used. Players move their pucks the number of spaces indicated by the total of the two dice when rolled. You work your way around the board to the scoring zone and to the net trying to score. Once you score, your puck goes back to the bench to be used again.

If you land on off sides, you have to go back two spaces. You cannot move until your next roll unless you have doubles. If you land on icing, you must go back to start until your next roll, unless you have doubles.

If you roll doubles you get to go again, but if you get doubles three times in a row, the closest man to the net has got to go back to the bench.

You can only have three pucks out on the ice at one time, unless you roll snake eyes. If this happens, you can have four pucks on the ice. If you get caught with four pucks on the ice and you know you did not deserve it, all your pucks have to go back to the bench and start over on your next roll.

If you get stuck and cannot move after two rolls, the closest puck to the net must go back to the bench and start again on your next roll.

You cannot move two pucks in combination with one dice roll. This means that you cannot split the roll between two pucks. For example, if you roll total of five, you cannot move one puck three spaces and another two spaces.

You cannot switch from one puck to another in the middle of a move, so look the board over before you move.

No player can have two pucks on one space at one time. If this happens, one puck has to go back to the bench.

If you land on the same place across from the other team, you can "check" him, sending him back to the bench and he has to start over again on his next roll When you are in front of the nets, the blue goal space and take a card space counts as one space together. In other words, these two spaces count as only one move.

The net counts as one space and a goal.

If you get a penalty shot card, you can use the closest puck to the net or you can use one off the bench. If he does not score he has got to go to the bench. This card can be used anytime during the game when it is your turn. After it is used put it back on face off cards marked discard.

If you get a penalty shot card, you roll once, using only one die giving you a better chance, if you do not roll three, you do not score and your puck must go back to the bench.

The penalty shot line is only used with penalty shot cards.

If you draw a card that says: hit the goal post, hit the cross bar, stick save, kick save, back hand shot save, glove save, goal under review—no goal, off the mask—no goal, whistle blew, wrist shot—what a save, slap shot—what a save, or tip in—what a save, your puck stays on that space until your next roll.

You must roll the exact number required to land on the net to score. Say you are five spaces from the net, you must roll five to score. If you roll more than the number needed to land on the net you cannot move. You must wait until your next roll then follow rules numbers 8, 13, and 14.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A hockey board game, consisting of:

a game board formed in the general shape of a hockey rink, including a first team goal and a second team goal disposed centrally at opposite ends of the board;

a first team track disposed around the circumference of the board and having an inwardly directed track section extending from near one end of the board to the first team goal;

a second team track disposed inwardly from the first team track and having an inwardly directed track section extending from near another end of the board to the second team goal;

bench areas disposed behind each of the first and second team goals;

wherein the first and second team tracks are divided into corresponding discrete sections;

wherein selected track sections include indicia that provide directions to players; and wherein game pieces shaped to resemble hockey pucks are used to represent the players' positions in their respective team tracks.

* * * * *